US005536911A

United States Patent [19]

Madill

[11] Patent Number: 5,536,911

[45] Date of Patent: Jul. 16, 1996

[54] LOW FORCE MULTI-DIRECTION MULTIPLE SWITCH ASSEMBLY

[75] Inventor: Jeffrey A. Madill, Acworth, Ga.

[73] Assignee: Scientific-Atlanta, Inc., Norcross, Ga.

[21] Appl. No.: 497,308

[22] Filed: Jun. 30, 1995

[51] Int. Cl.[6] ..... H01H 13/70; H01H 25/04

[52] U.S. Cl. ..... 200/6 A; 600/5 A

[58] Field of Search ..... 200/5 R, 5 A, 200/6 A, 275, 512–517, 86 R, 302.1–302.3; 345/150–185

[56] References Cited

U.S. PATENT DOCUMENTS

| | | | |
|---|---|---|---|
| 4,029,915 | 6/1977 | Ojima | 200/5 A |
| 4,256,931 | 3/1981 | Palisek | 200/5 A |
| 4,687,200 | 8/1987 | Shirai | 200/5 AX |
| 4,892,981 | 1/1990 | Soloway et al. | 200/5 A |
| 4,947,461 | 8/1990 | Yoshioka et al. | 200/5 R |
| 4,975,547 | 12/1990 | Nakayama et al. | 200/5 R |
| 4,992,631 | 2/1991 | Gee | 200/5 A |
| 5,396,030 | 3/1995 | Matsumiya et al. | 200/6 A |

*Primary Examiner*—J. R. Scott
*Attorney, Agent, or Firm*—John Victor Pezdek

[57] ABSTRACT

A low force, multiple switch, multidirectional switch assembly for electronic games handsets or remote controls. The assembly comprises a housing having an opening, a first support and a second support having a opening. At least two spaced apart switches are provided, each comprising two spaced apart stationary contacts on the first support and a correspondingly aligned moveable contact on the second support. When closed, the moveable contact electrically connects the two stationary contacts. Bumper pads, corresponding in number and shape to the moveable contacts, are provided at a predetermined distance between adjacent moveable contacts. A spring, located between the second support and the first support and extending about the periphery of the second support, holds the second support apart from the first support and each switch open. A switch actuation is positioned between the housing and the second support with a first portion passing through the housing opening and a second portion keeping the switch actuator in the housing. The spring also holds the second portion against the housing when the switches are open. A third portion of the switch actuator passing through the second support opening remains spaced apart from the first support when the switches are open and when a switch is closed using normal closing force. With a switch closed, as movement of the switch actuator continues due to excessive force being applied, the end of the third portion and the bumper pads seat against the first support ensuring that adjacent switches are not closed due to the excessive applied force. Four switches and bumper pads or eight switches and bumpers pads can be used. Alternately the spring may be integrally molded in the second support.

23 Claims, 3 Drawing Sheets

LOW FORCE MULTI-DIRECTION MULTIPLE SWITCH ASSEMBLY

BACKGROUND Of THE INVENTION

1. Technical Field

The field of this invention is switches and, in particular, multi-directional, multiple switch assemblies such as those found in electronic game device handsets or remote control devices for televisions.

2. Description of the Prior Art

In electronic video game devices, a handset is typically provided for controlling the action of the game as it appears on the television screen or monitor. These handsets include various switches including pushbutton switches and directional switches. As shown in FIG. 1, the directional switch assembly, generally indicated at 10, typically has four switches, 12, 14, 16, 18, one for each direction, East, West, North and South. Each switch consist of a moveable contact or conductive rubber pad 20, sometimes called "pucks" due to the miniature "hockey puck" appearance, which are positioned over corresponding stationary contacts 22 formed of conductive fingers 24 on a printed circuit board or support 26 located in the handset. The stationary contacts 22 on the printed circuit board may be either plated copper or a conductive paint or ink which is applied by a printing process. By pressing a button or portion of an actuator 28 positioned over the moveable contact 20, the moveable contact 20, in its closed position, seats against its corresponding stationary contact 22 and closes a circuit between the conductive fingers 24 printed on the circuit board 26. In typical usage, each moveable contact 20 is individually supported by a silicone rubber membrane spring 30 which yields a consistent force profile as it is collapsed. The button which is pressed to close the switch is often molded in the surface of the rubber membrane opposite that of the conductive rubber pad, but a separate plastic actuator can be used as shown in FIG. 1. In a typical 4-direction assembly, the moveable contacts of all four switches are molded into the membrane to form a single directional assembly with one switch for each direction.

Typical forces to close a single switch range from 150 to 50 grams and the force profiles are relatively standard. The typical directional actuator, having the four directional switches, relies on four separate membrane switches which support the actuator. Because all four switches contact the actuator, all must be partially compressed to close one switch increasing the force actually required to close the switch beyond that required for a single switch. The magnitude of these closing forces has been alleged to cause repetitive stress injuries to the fingers and thumbs of game players of typical electronic games. To achieve reduced closing force very thin rubber membrane springs can be used. However, this reduces that amount of force available to return the moveable contact (i.e the puck) and the switch to the open position leading to unreliable switch operation. In addition, should the user provide excessive closing force, the switches adjacent the one intended to be closed may also close. This may cause an inaccurate action in the game being played or an incorrect response in the television set being controlled.

It would be advantageous to have a multidirectional switch assembly that has a lower actuation force. Further, it would also be advantageous to have a multidirectional switch assembly where on excessive closing force being applied to one of the switches the adjacent switches are not prone to close. It would also be advantageous to reduce the closing force for a switch without having to use very thin rubber membrane springs.

SUMMARY OF THE INVENTION

The switch assembly of the present invention comprises a housing having an opening therethrough, a first support positioned in the housing and a second support having a opening therethrough. At least two spaced apart switches are provided. Each switch has an open position and a closed position and comprises two spaced apart electrically conductive stationary contacts mounted on the first support and a moveable contact mounted on the second support and aligned with the corresponding stationary contacts such that when the switch is in the closed position the moveable contact electrically connects the two stationary contacts. Bumper pads corresponding in number and shape to the number of moveable contacts are mounted on the second support at a predetermined distance between adjacent moveable contacts. A spring is positioned between the second support and the first support and extending substantially about the periphery of the second support. The force of the spring holds the second support in a spaced apart relationship with respect to the first support and each switch in the open position. Actuation means for acting against the spring is positioned between the housing and the second support. A first portion of the actuation means passes through the opening in the housing and a second portion of the actuation means having a dimension that is larger than the opening in the housing acts to hold the actuation means in the housing. The spring also acts to hold the second portion of the actuation means against the housing when the switches are in the open position. A third portion of the actuation means has a length sufficient to pass through the opening in the second support but remain spaced apart from the first support when the switches are in the open positions and when the switch is closed using normal closing force. In use, a switch is moved to the closed position by initial movement of the actuation means adjacent the moveable contact of such switch. The actuation means movement acts against that portion of the spring adjacent that moveable contact causing that switch to begin to move from the open position to the closed position. The adjacent bumper pads also begin moving toward the first support. As normal closing force continues to be applied the moveable contact will seat against the corresponding stationary contacts, closing the switch. With the switch in the closed position, as further movement of the actuation means continues due to excessive force being applied, the end of third portion of the actuation means meets or seats against the first support and the bumper pads meet or seat against the first support acting as stops to ensure that adjacent switches are not closed due to the excessive force being applied. The switch assembly of the present invention reduces the actuation force required to close a switch and while preventing the adjacent moveable contacts of the other switches from closing and advantageously avoiding the use of thin rubber membrane springs. Preferably, either four switches and four bumper pads or eight switches and eight bumpers pads are used in the switch assembly.

BRIEF DESCRIPTION OF THE DRAWINGS

These and other objects, features and aspects of the invention will be more clearly understood if the following detailed description is read in conjunction with the drawings where the same or similar elements will carry the same or similar number and in which.

DETAILED DESCRIPTION OF THE INVENTION

Figure 2:
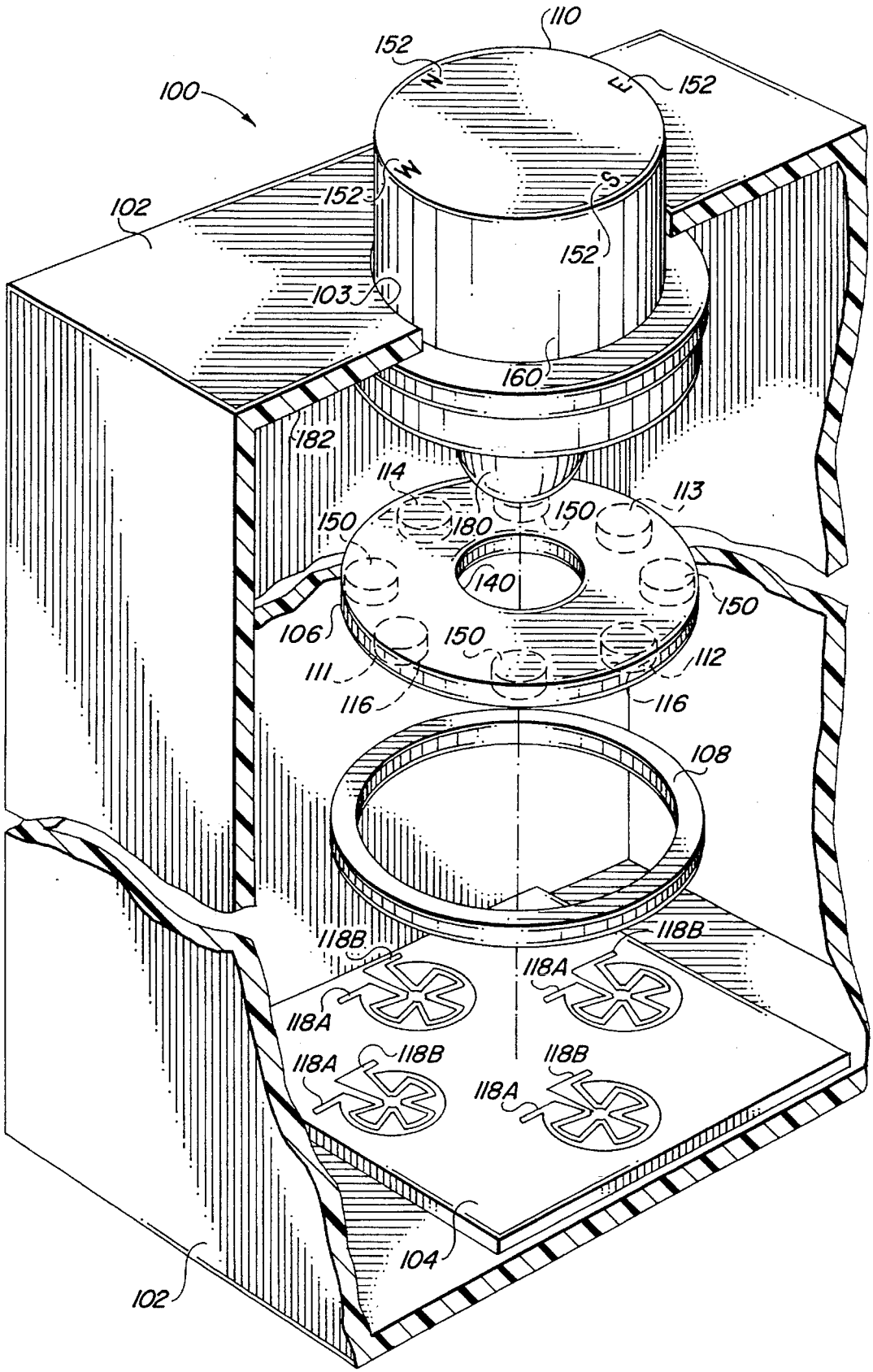
FIG. 2 is a cross-sectional exploded view illustration of a multiple contact, multidirectional switch assembly embodying the present invention.

The present invention embodies a multiple switch, multi-directional assembly preferably for use with electronic game sets or remote control devices. As shown in FIG. 2, the switch assembly, generally designated as 100, is comprised of the housing 102, a first support 104 positioned in the housing 102, a second support 106 positioned in the housing 102, a spring 108 positioned intermediate the first support 104 and the second support 106 and preferably integrally molded with the second support 106, an actuation means 110 positioned intermediate the second support 106 and the housing 102, and at least two switches. Preferably, at least four switches, 111,112,113, and 114 are provided in the switch assembly 100 as shown in FIG. 2. For illustrative purposes only, switches 111–114 represent the directions West, South, East and North, respectively. Each switch 111–114 is comprised of a movable contact 116 and two stationary contacts 118. The movable contact 116 for each of the switches are positioned on the second support 106. Preferably, each moveable contact 116 is formed of an electrically conductive elastomeric material. Opposite each movable contact 116 are its two corresponding spaced apart, stationary contacts 118A and 118B which are positioned on the first support 104. Each stationary contact comprises at least 2 spaced apart, planar, conductive fingers 120 with alternating fingers being electrically in common (see FIG. 3). The stationary contacts may be either plated copper or a conductive paint or ink which is applied by a printing process on to the first support 104. Preferably, each stationary contact in each switch comprises four triangular or wedge-shaped conductive fingers as shown in FIG. 2. The eight triangular fingers are radially arranged in a circular fashion, like the pieces in a pie, and spaced apart with alternate triangular fingers being electrically interconnected. For example, if the fingers are numbers 1 through 8, then alternate fingers 1,3,5, and 7 are joined at their tips in the center of the circle (for example, see stationary contact 118B in FIG. 2) while the other four alternate fingers 2, 4, 6, 8 are 5 joined at their bases (for example, see stationary contact 118A in FIG. 2). The space or gaps between the triangular fingers occurs at every 45 degrees, normally starting at zero degrees. With this arrangement of conductive fingers and orientation of the gaps between the fingers, only a small portion of the moveable contact 116 needs to be seated on adjacent portions of two of the alternate fingers in order to close the switch. Other arrangements and shapes of contact fingers can be employed to achieve many types of switching patterns.

An opening 130 is provided in the housing 102 adjacent the actuation means 110. An opening 140 is also provided in the second support 106. Positioned between adjacent ones of the movable contacts 116 are bumper pads 150. Bumper pads 150 have the same height as the movable contacts and preferably are formed of elastomeric materials. Various shapes, for example, cylindrical, box, or domed, can be used for the bumper pads 150. Preferably, moveable contacts 116 and bumper pads 150 are integrally formed into the second support 106.

On the actuation means 110 are directional indicia 152, typically one for each switch provided in the assembly 100. For example if compass directions are needed for the four switch assembly, the letters W, S, E, N are provided on a portion of the actuation means 110 visible to the user and are indicia for the directions North, East, West and South. Left, right, down and up arrows can also be used as directional indicia. Typically, when four switches are provided, the four switches are positioned ninety degrees apart from one another. The West, South, East and North switches are switches 111, 112, 113 and 114, respectively. The actuation means 110 is positioned on the second support 106 such that the indicia 152 are aligned with the corresponding movable contact of the switch which is positioned for that direction. As is known in the art, alignment aids can be provided on the actuation means and the second support to ensure correct alignment between the moveable and station contacts and the actuation means. For example, a key (not shown) can be provided on the actuation means 110 for insertion into a keyway (not shown) provided in the opening 140 of the second support 106 to aid in the alignment of these two elements. Similar devices can be provided between the second support and the first support.

Figure 3:
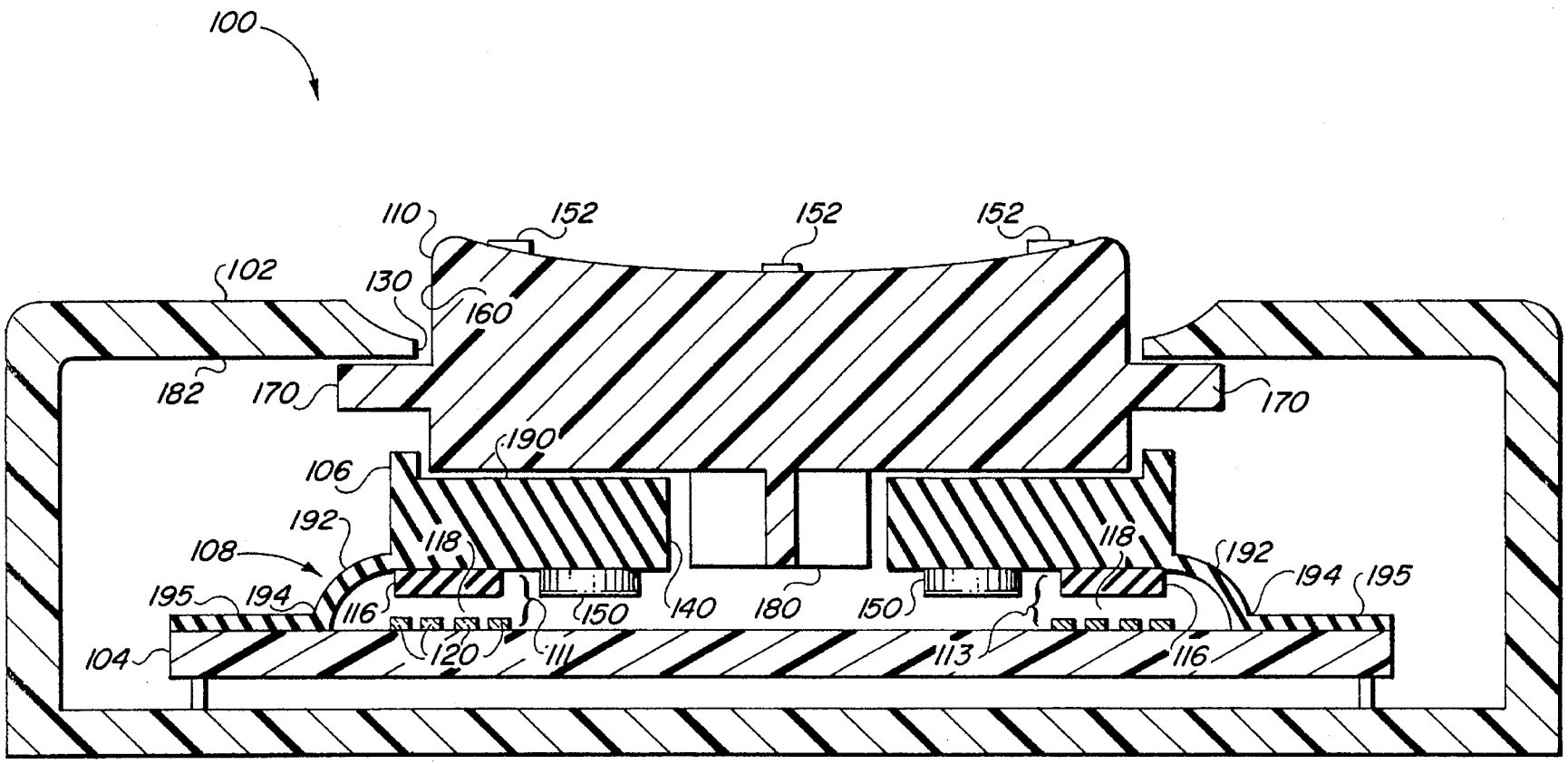
FIG. 3 is a cross-sectional illustration of an alternate embodiment of the present invention; and, FIG. 4A and FIG. 4B schematically represent alternate embodiments which allow for variance in diagonal directions including the location of bumper pads.

A first portion 160 of the actuation means 110 passes through the opening 130 in the housing 102. A second portion 170 of the actuation means 110 has a dimension which is greater than opening 130 and preferably is skirt or flange extending about the periphery of the actuation means 110. A third portion 180 of the actuation means 110 passes through the opening 140 in the second support 106 extending in length beyond the height of the moveable contacts 116 and bumper pads 150 toward the first support 104. The spring 108 acts to hold the second support 106 in a spaced apart manner from first support 104 thereby placing switches 111–114 in the open position with the movable contacts 116 spaced apart from their correspondingly aligned stationary contacts 118A and 118B. The spring 108 also acts to seat the second portion 170 of the actuation means against the inner surface 182 of the housing 102. The second portion 170 of the actuation means 110 prevents the removal of the actuation means 110 from the switch assembly via opening 130. When all the switches are in the open position, the third portion 180 of the actuation means 110 has a length such that the end thereof remains spaced apart from the first support 104 when switches 111–114 are in their open positions and when one of the switches is closed using normal closing force. The third portion 180 of the actuation means 110 can have various shapes but preferably it is cylindrical or cruciform (as shown in FIG. 3) having either a flat or rounded end. Preferably, the first and third portions 160 and 180, respectively of the actuation means 110 are sized to be closely received but slidable in their respective openings 130 and 140.

To operate one of the switches, the actuation means 110 is depressed by the user at the desired indicia 152. The closing force applied by the user acts against, compresses or collapses the spring 108 lowering the movable contact 116 toward its corresponding stationary contacts 118A and 118B until the switch is closed as a portion of the moveable contact 116 seats against adjacent portions of stationary contacts 118A and 118B. If the user continues to apply additional force after the switch is in the closed position, the end of the third portion 180 or the bumper pads 150 adjacent the closed switch contact the first support 104 and act as a stop. The amount and direction of excess closing force applied to the switch determines whether or not the third portion 180, the bumper pads 150 or a combination of these seat against the first support 104. For example if the excess closing force were applied in a diagonal direction, the bumper pad 150 adjacent the switch in that diagonal direction would seat. The seating action of the adjacent bumper pads 152 prevents the adjacent switches from also closing as more excess closing force is applied by the user to the actuation means 110. For instance if the East switch 113 were being closed the adjacent switches would be the North and South switches 114 and 112, respectively.

In an alternate embodiment of the invention as shown in FIG. 3, the second support 106 and the spring 108 are preferably integrally formed from an elastomeric material, such as silicone rubber. With such an assembly, the second support 106 has a base 190 having the opening 140 therethrough and an outwardly depending wall 192 extending toward or curved toward the first support 104 and extending substantially about the periphery of the base 190. Preferably the base 190 and opening 140 are substantially circular with the opening 140 centered in the base 190. The end 194 of the wall 192 makes contact or seats upon the first support 104 so as to substantially enclose the stationary contacts 118 of switches 111–114. In cross section, the wall and base are substantially U-shaped. Preferably, the end 194 of the wall 192 is joined or integrally molded to a rubber membrane 195 which covers the entire surface of the support 104 to seal the switch assembly. The cross-sectional thickness of the wall 192 is less than that of the base 190 and that of the rubber membrane 195. If the base thickness were approximately 1 mil, the wall thickness would be approximately 0.5 mils. Having a thinner cross-section and combining with is outwardly curved shape makes the wall 192 more flexible than the base 190 allowing it to act as and form the spring 108. This construction allows the use of thicker membrane springs than the membrane springs used in switch assemblies of the prior art. The difference in cross-sectional thickness between the wall 192 and the base 190 is dependent on the nature of the material. Preferably, the cross-section of the wall 192 is such that the spring which is subsequently formed has sufficient force to (1) when the switches 111–114 are in their open position to hold all of the movable contacts 116 of all of the switches in the open position and hold the second portion 170 of the actuation means 110 against the inner surface 182 of the housing 102 and (2) on release of a closed switch have sufficient restoring force to return the actuation means 110 to its initial position and the switches 111–114 to their open positions. For the four-switch switch assembly having a plastic actuation means, the restoring force required of the spring would be approximately 1000 grams.

Figure 1:
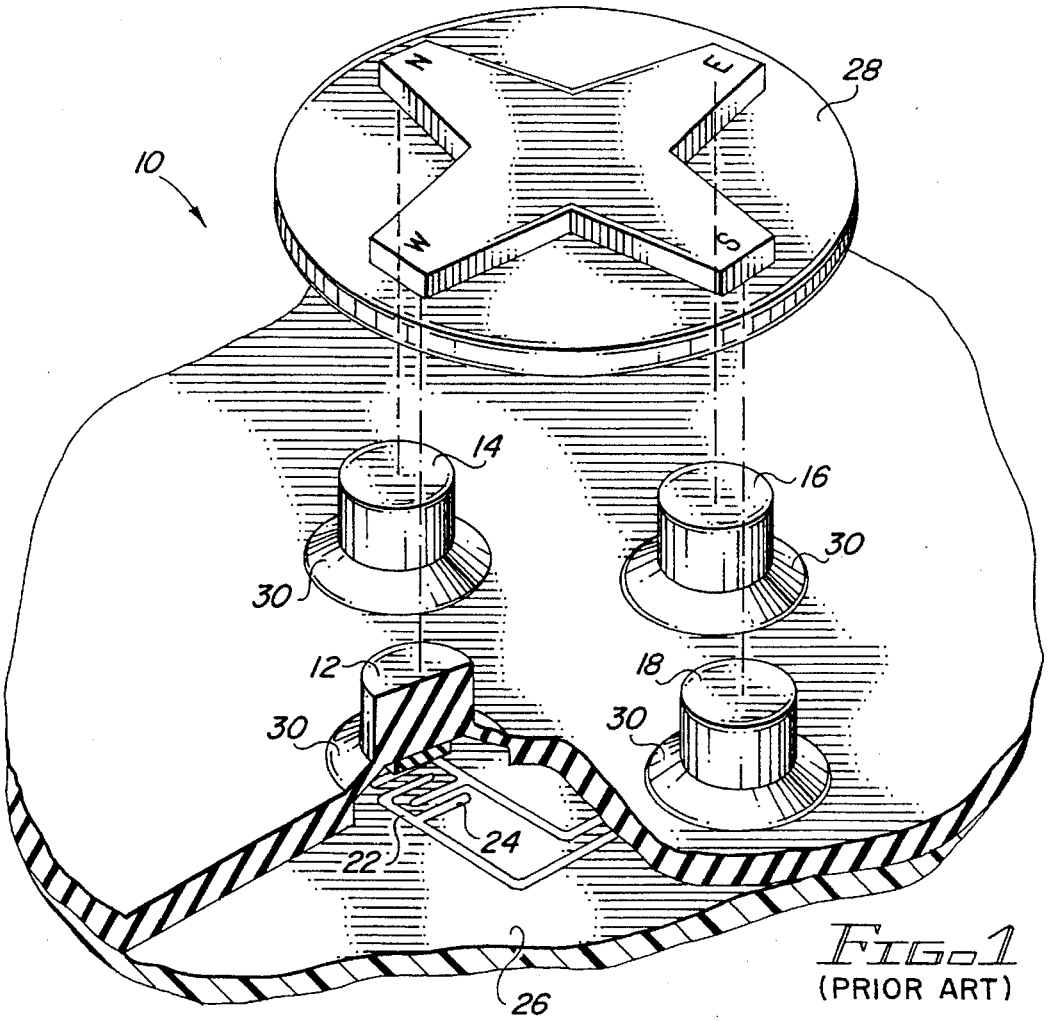
FIG. 1 (PRIOR ART)
FIG. 1 is an illustration, in partial cross section of a multiple contact, multi-directional switch assembly of the prior art.
Figure 4A:
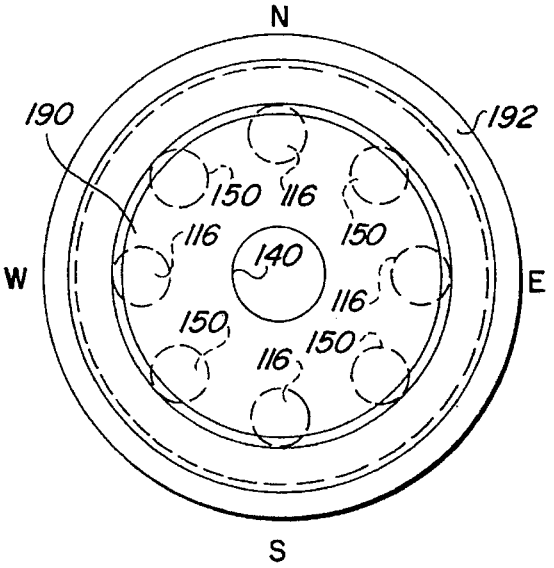

Shown in FIG. 4A is an arrangement where the moveable contacts 116 and bumper pads 150 are molded into the base 190. There the bumper pads 150 are positioned intermediate the moveable contacts 116, with both the bumper pads and moveable contacts radially positioned in a circular fashion about the opening 140. In addition, the actuation means 110 can also be integrally formed with the second support 106.

Figure 4B:
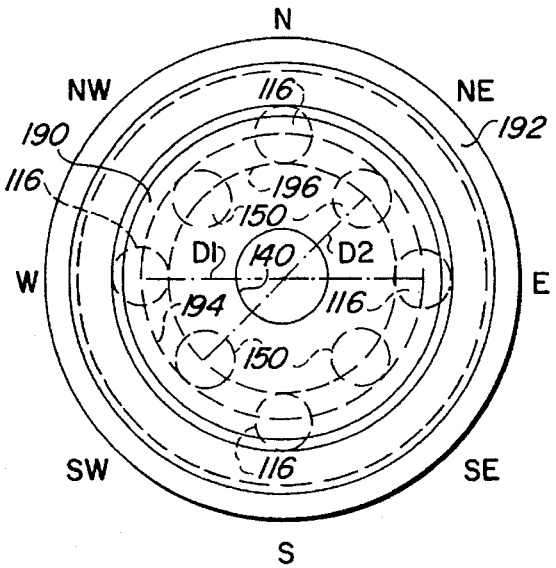

When the use of diagonal positions is required, the present invention may be modified to allow for the simultaneous closure of two switches as shown in FIG. 4B. For instance, to generate a signal indicating a northeasterly direction, the actuation means 110 would be pressed intermediate the North and East indicia. By repositioning the bumper pads 150, the simultaneous closure of both the North and East switches 113 and 114, respectively, is possible. The movable contacts 116 of the switches 111–114 are radially positioned on the base 190 in a first circle 194 centered about the opening 140 having a diameter D1. The bumper pads 150 are also radially positioned on the base 190 in a second circle 196 centered about the opening 140 having a diameter D2. The diameters D1 and D2 are measured to the approximate center points of the moveable contacts or bumper pads, respectively. In the four-directional switch where diagonal directions—Northeast, Southeast, Southwest and Northwest—are not required, the diameters D1 and D2 of the first and second circles 194 and 196 would be equal with the bumper pads and moveable contacts being equally spaced apart. In the alternate embodiment of the switch assembly where diagonal directions are desired, the diameter D2 of the second circle 196 for the bumper pads is less than that of the first circle 194, preferably about the width or diameter of the moveable contact. This positions the bumper pads 150 closer to the opening 140 and allows for actuation means 110 when depressed at one of the diagonal directions to simultaneous close the two switches immediately adjacent that diagonal location. For example, if the Southwest diagonal direction is chosen, switches 111 and 112 would be closed by depressing the actuation means 110 on the Southwest indicia. Here however the bumper pad 150 intermediate the two moveable contacts of the South and West switches, respectively would seat against the first support 104 when the two switches are closed. The remaining bumpers 150 and third portion 180 prevent the North and East 113 and 114, respectively, switches from closing.

Variations and modifications to the describe methods and apparatus, within the scope of the invention, will suggest themselves to those skilled in the art and should be taken as illustrative. The invention is intended to encompass all such modifications which are within the spirit and scope of the claims.

I claim:

1. A multiple switch assembly comprising:

a housing having an opening therethrough;

a first support positioned in the housing;

a second support having a opening therethrough;

at least two spaced apart switches, each switch having an open position and a closed position and comprising:

two stationary contacts mounted on the first support and comprising at least two spaced apart electrically conductive members;

a moveable contact mounted on the second support and aligned with the corresponding stationary contacts such that when the switch is in the closed position the moveable contact electrically connects the two electrically conductive members of the respective stationary contact;

bumper pads corresponding in number and height to the moveable contacts and mounted on the second support at a predetermined distance between adjacent moveable contacts;

a spring positioned between the second support and the first support and extending substantially about the periphery of the second support, the spring holding the second support in a spaced apart relationship with respect to the first support and each switch in the open position;

actuation means for acting against the spring and positioned between the housing and the second support, the actuation means having a first portion passing through the opening in the housing and a second portion having a dimension that is larger than the opening in the housing with the spring acting to hold the second portion of the actuation means against the housing when the switches are in the open position, the actuation means further having a third portion having a length sufficient to pass through the opening in the second support and beyond the moveable contacts but remain spaced apart from the first support when the switches are in the open positions whereby a switch is moved to the closed position by applying force to the portion of the actuation means adjacent the moveable contact of such switch acting against that portion of the spring adjacent that moveable contact causing that switch to move from the open position to the closed position with the adjacent bumper pads moving toward the first support ,and, as further excess force is applied the end of third portion of the actuation means and the adjacent bumper pads acting singly or in combination depending on the magnitude of the excess force being applied seat against the first support preventing adjacent moveable contacts on the second support from closing with their respective stationary contacts.

2. The switch assembly of claim 1 wherein the second support further comprises:

a base having the opening therethrough and on which the bumper pads and moveable contacts are positioned; and, an outwardly curved wall depending from the periphery of the base toward the first support, having a thickness that is less than that of the base forming the spring and with the end of the wall seating against the first support.

3. The switch assembly of claim 2 wherein the base is substantially circular with the opening positioned at the center thereof and the moveable contacts and bumper pads being substantially equidistantly and radially spaced apart from one another.

4. The switch assembly of claim 3 wherein second support has a substantially U-shaped cross section and is formed from an elastomeric material.

5. The switch of claim 4 wherein the bumper pads and moveable contacts are integrally formed in the base of the second support.

6. The switch assembly of claim 3 wherein four switches are provided with the moveable contacts thereof positioned substantially along a first circle centered about the opening in the base and four bumper pads are positioned substantially along a second circle centered about the opening in the base, where the diameters of the first and second circles are substantially equal.

7. The switch assembly of claim 6 wherein the diameter of the second circle is less than the diameter of the first circle.

8. The switch of claim 2 wherein the second support member and the actuation means are integrally molded as one piece.

9. The switch assembly of claim 3 wherein the second support member and the actuation means are integrally molded as one piece.

10. A multiple switch assembly comprising:

a housing having an opening therethrough;

a first support positioned in the housing;

a second support comprising:

a base having a opening therethrough; and, an outwardly curved wall depending substantially about the periphery of the base toward the first support forming a spring for holding the base in a spaced apart relationship with respect to the first support, the wall having a thickness that is less than that of the base;

at least two spaced apart switches, each switch having an open and a closed position and comprising:

two stationary contacts mounted on the first support and each comprising at least two substantially planar, spaced apart, electrically conductive fingers;

a moveable contact mounted on the base of the second support intermediate the opening and the wall and aligned with the corresponding stationary contacts such that when the switch is in the open position the moveable contact is held apart from the stationary contacts by the spring of the second support and when the switch in the closed position the moveable contact electrically connects the two electrically conductive fingers of the respective stationary contacts;

bumper pads corresponding in number to and height as the moveable contacts, the bumper pads being mounted on the base at a predetermined distance between adjacent moveable contacts;

actuation means for acting against the spring when a force is applied thereto and positioned between the housing and the second support, the actuation means having a first portion passing through the opening in the housing and having sufficient length to remain in the opening in the housing when any of the switches are moved from its open position to its closed position, the first portion having a number of indicia thereon corresponding and aligning with the switches, the actuation means having a second portion having a dimension that is larger than the size of the opening in the housing with the spring acting to hold the second portion of the actuation means against the housing when the switches are in the open position, the actuation means having a third portion having a length sufficient to pass through the opening in the base and extend beyond the height of the moveable contacts but remain spaced apart from the first support when the switches are in the open positions, whereby a switch is moved to the closed position by applying force to the portion of the actuation means adjacent the indicia acting against that portion of the spring adjacent that moveable contact causing that switch to move from the open position to the closed position with the adjacent bumper pads moving toward the first support ,and, as further excess force is applied the end of third portion of the actuation means and the adjacent bumper pads acting, singly or in combination, depending on the magnitude of the excess force being applied, seat against the first support preventing adjacent moveable contacts on the second support from closing with their respective stationary contacts.

11. The switch assembly of claim 10 wherein the base is substantially circular with the hole therethrough being centered therein and the moveable contacts and bumper pads are equidistantly spaced from one another in a radial arrangement about the center of the base.

12. The switch of claim 10 wherein the second support formed of the base and wall has a substantially U-shaped cross section and is formed from an elastomeric material.

13. The switch of claim 10 wherein the bumper pads and moveable contacts are integrally formed in the base.

14. The switch of claim 12 wherein the bumper pads and moveable contacts are integrally formed in the base.

15. The switch assembly of claim 12 wherein four switches are provided with the moveable contacts thereof positioned substantially along a first circle centered about the opening in the base and four bumper pads are positioned substantially along a second circle centered about the opening in the base, where the diameters of the first and second circles are substantially equal.

16. The switch assembly of claim 12 wherein the diameter of the second circle is less than the diameter of the first circle.

17. The switch of claim 12 wherein the second support and the actuation means are integrally molded as one piece.

18. The switch assembly of claim 13 wherein four switches are provided with the moveable contacts thereof positioned substantially along a first circle centered about the opening in the base and four bumper pads are positioned substantially along a second circle centered about the opening in the base, where the diameters of the first and second circles are substantially equal.

19. The switch assembly of claim 13 wherein the diameter of the second circle is less than the diameter of the first circle.

20. The switch of claim 13 wherein the second support and the actuation means are integrally molded as one piece.

21. A multiple switch assembly comprising:

a housing having a circular opening therethrough;

a first support positioned in the housing;

a second support formed of an elastomeric material comprising:

a substantially circular, planar base having a opening therethrough positioned at the center thereof; and, an outwardly curved wall depending substantially about the periphery of the base toward the first support forming a spring for holding the base in a spaced apart relationship with respect to the first support, the wall having a thickness that is less than that of the base with the base and wall having a substantially U-shaped cross section;

at least two spaced apart switches, each switch having an open and a closed position and comprising:

two stationary contacts mounted on the first support with each contact comprising at least four triangular, substantially planar, spaced apart, electrically conductive fingers with four fingers of one stationary contact being alternately positioned between and spaced apart from the four fingers of the other stationary contact and all fingers radially arranged in a circle with the spacing therebetween occurring approximately every 45 degrees;

a substantially planar, moveable contact integrally molded on and depending from the base of the second support intermediate the opening and the wall and aligned with a corresponding stationary contact such that when the switch is in the open position the moveable contact is held apart from its respective stationary contact by the spring and when the switch in the closed position the moveable contact electrically connects the two electrically conductive fingers of its respective stationary contacts;

bumper pads corresponding in number to and substantially the same height as the moveable contacts, the bumper pads being mounted on the base at a predetermined distance between adjacent moveable contacts actuation means for acting against the spring and positioned between the housing and the second support, the actuation means having a substantially cylindrical first portion passing through the opening in the housing and having sufficient length to remain in the opening in the housing when any of the switches are moved from its open position to its closed position, the first portion having a number of indicia thereon corresponding in number and aligned with the switches, the actuation means having a substantially cylindrical second portion having a diameter that is larger than the size of the opening in the housing with the spring acting to hold the second portion of the actuation means against the housing when the switches are in the open position, the actuation means having a substantially cylindrical third portion having a diameter sized to be closely received but slidable in the opening in the base and having a length sufficient to pass through the opening in the base and extend beyond the moveable contacts but with the end remaining spaced apart from the first support when the switches are in the open positions.

22. The switch assembly of claim 21 wherein four switches are provided with the moveable contacts thereof positioned substantially along a first circle centered about the opening in the base and four bumper pads are positioned substantially along a second circle centered about the opening in the base, where the diameters of the first and second circles are substantially equal.

23. The switch assembly of claim 21 wherein the diameter of the second circle is less than the diameter of the first circle.

* * * * *